United States Patent [19]

Layrisse R. et al.

[11] Patent Number: 4,795,478

[45] Date of Patent: Jan. 3, 1989

[54] VISCOUS HYDROCARBON-IN-WATER EMULSIONS

[75] Inventors: Ignacio A. Layrisse R., Estado Miranda; Domingo R. Polanco, Edo. Miranda; Hercilio Rivas; Euler Jimenez G., both of Caracas; Lirio Quintero; Jose Salazar P., both of Edo. Miranda; Mayela Rivero, Edo. Mérida; Antonio Cardenas, Caracas; Maria L. Chirinos, Caracas; Daysi Rojas, Caracas; Humberto Marquez, Caracas, all of Venezuela

[73] Assignee: Intevep, S.A., Caracas, Venezuela

[21] Appl. No.: 96,643

[22] Filed: Sep. 11, 1987

Related U.S. Application Data

[63] Continuation-in-part of Ser. No. 14,871, Feb. 17, 1987, which is a continuation-in-part of Ser. No. 875,450, Jun. 17, 1986.

[51] Int. Cl.[4] ..... C10L 1/32

[52] U.S. Cl. ..... 44/51; 137/13; 166/371; 252/312; 431/1

[58] Field of Search ..... 137/13; 431/1, 3, 4; 166/371; 44/51; 55/45, 55, 171, 208; 252/312

[56] References Cited

U.S. PATENT DOCUMENTS

| | | | |
|---|---|---|---|
| 3,380,531 | 4/1968 | McAuliffe et al. | 166/371 |
| 3,467,195 | 9/1969 | McAuliffe et al. | 166/371 |
| 3,519,006 | 7/1970 | Simon et al. | 137/13 |
| 3,807,932 | 4/1974 | Dewald | 431/4 |
| 3,876,391 | 4/1975 | McCoy et al. | 44/51 |
| 3,902,869 | 9/1975 | Friberg et al. | 44/51 |
| 3,943,954 | 3/1976 | Flourney et al. | 137/13 |
| 4,002,435 | 1/1977 | Wenzel et al. | 44/51 |
| 4,046,519 | 9/1977 | Piotrowski | 44/51 |
| 4,084,940 | 4/1978 | Lissant | 44/51 |
| 4,099,537 | 7/1978 | Kalfoglou et al. | 137/13 |
| 4,108,193 | 8/1978 | Flourney et al. | 137/13 |
| 4,144,015 | 3/1979 | Berthiaume | 431/8 |
| 4,158,551 | 6/1979 | Feurman | 44/51 |
| 4,162,143 | 7/1979 | Yount, III | 44/51 |
| 4,239,052 | 12/1980 | McClaflin | 137/13 |
| 4,315,755 | 2/1982 | Hellsten et al. | 44/51 |
| 4,379,490 | 4/1983 | Sharp | 166/371 |
| 4,382,802 | 5/1983 | Beinke et al. | 44/51 |
| 4,392,865 | 7/1983 | Grosse et al. | 44/51 |
| 4,416,610 | 11/1983 | Gallagher et al. | 44/51 |
| 4,445,908 | 5/1984 | Compere et al. | 44/51 |
| 4,477,258 | 10/1984 | Lepain | 44/51 |
| 4,488,866 | 12/1984 | Schirmer | 431/4 |
| 4,512,774 | 4/1985 | Myers | 44/51 |
| 4,570,656 | 2/1986 | Matloch et al. | 137/13 |
| 4,618,348 | 10/1986 | Hayes et al. | 431/4 |
| 4,627,458 | 12/1986 | Prasad | 137/13 |

FOREIGN PATENT DOCUMENTS 0974042 11/1964 United Kingdom .

OTHER PUBLICATIONS

Sekiyu et al., 56-159291(A) Removal of Sulfur Oxide and Nitrogen Oxide, Japanese, 8-12-1981.

*Primary Examiner*—William R. Dixon, Jr.
*Assistant Examiner*—Margaret B. Medley
*Attorney, Agent, or Firm*—Bachman & LaPointe

[57] ABSTRACT

Method for the formation, processing, transportation and end use of a hydrocarbon-in-water emulsion.

45 Claims, 6 Drawing Sheets

T= 100 °C

T= 100°C
NaCL = 5000 mg/

T= 100°C
NaCL = 10,000 mg/L NaCL

115°C
5000 mg/L NaCL

115°C
10,000 mg/L NaCL

VISCOUS HYDROCARBON-IN-WATER EMULSIONS

CROSS REFERENCE TO RELATED APPLICATIONS

This application is a continuation-in-part of application Ser. No. 14,871, filed Feb. 17, 1987 which in turn is a continuation-in-part of application Ser. No. 875,450, filed June 17, 1986.

RELATED PRIOR ART

Te most pertinent related prior art dealing with the formation of hydrocarbon-in-water emulsions from viscous hydrocarbons for use as a combustible fuel are British Patent Specification 974,042 and U.S. Pat. No. 4,618,348. Additional prior art patents dealing with the combustion of hydrocarbon/water emulsions of the oil-in-water (o/w) and water-in-oil (w/o) type are U.S. Pat. Nos. 3,958,915, 4,273,611, 4,382,802, 3,352,109, 3,490,237 and 4,084,940.

Pertinent prior art patents dealing with the formation and transportation of hydrocarbon-in-water emulsions are as follows: U.S. Pat. Nos. 3,380,531; 3,487,844; 3,006,354; 3,425,429; 3,467,195; 4,239,052 and 4,249,554.

Other known prior art dealing with hydrocarbon-in-water emulsions of the o/w and/or w/o type are as follows: R. E. Barrett et al., "Design, Construction and Preliminary Combustion Trials of a Rig to Evaluate Residual Fuel-Oil/Water Emulsions", Battelle M. I., Columbus, Ohio, PB-214260, July 15, 1970. R. Helion et al., "Reduction of Flue Gas Emissions by Burning Fuel-Oil-Water Emulsions", VGB Kraftwerkstechnik 1975, 55(2), 88–93, [59-Air Pollution, Ind. Hyg. vol. 84, 1976, p. 335, No. 84:78995g]. N. Moriyama et al., "Emulsifying Agents for Oil-In-Water Type Emulsion Fuels", Japan Kokai 77-151305, Dec. 15, 1977, Based on Appln. No. 76/68,530, Jun. 11, 1976, [51-Fossil Fuels, vol. 80, 1978, p. 145, No. 89:8710q]. A. Iwama, "Single Droplet Combustions of Emulsified Hydrocarbon Fuels. II. Comparison of Combustion Characteristics Between O/W and W/O Emulsions", Nenryo Kyokaishi 1979, 58(632): 1041–54, (Japan) [Chem. Abstr. vol. 93, 1980, p. 204, No. 93:50075u]. Rosenberg et al., "Interaction of Acinetobacter RAG-1, Emulsan with Hydrocarbons" in: Advances in Biotechnology, vol. III, Fermentation Products, Proceedings of the VIth International Fermentation Symposium held in London, Canada, July 20–25, 1980, pp. 461–466, (M. Moo-Ybung, Ed., 1981). Y. Murakami et al., "Burning of Emulsified Oil Waste", Osaka Kogyo Gijutsu Shikensho Kiho 1972, 23(3), 184–8 [Chem. Abstr. vol. 78, 1973, p. 222, No. 61800t]. H. Ludewig, "Hydrocarbon-Emulsifier-Water Emulsion", East German Pat. No. 93,398, Oct. 20, 1972, based on Appln. No. 148,658, July 8, 1978, [Chem. Abstr. vol. 80, 1974, p. 150, No. 85531y]. K. Enzmann et al., "Preparation of Fuel Oil-In-Water Emulsions for Combustion", Universal'n Dezintegratorn Aktivatsiya Tallin 1980, 82-6, (Russ.) from Ref. Zh. Khim 1980, Abstr. No. 14P334[51-Fossil Fuels vol. 93, 1980, p. 147, No. 93:170678q]. O. Neumeister et al., "Method and apparatus for Preparing Fuel-Water Emulsions", East German Patent No. DD216,863, Jan. 2, 1985, based on Appln. No. 253,527, July 29, 1983. R. E. Barrett et al., "Residual Fuel Oil-Water Emulsions", Battelle M. I., Columbus, Ohio, PB-189076, Jan. 12, 1970.

BACKGROUND OF THE INVENTION

The present invention is drawn to methods for recovering and/or processing a viscous hydrocarbon material and conditioning same as a hydrocarbon-in-water emulsion for further processing.

Low gravity, viscous hydrocarbons found in Canada, The Soviet Union, United States, China and Venezuela are normally liquid with viscosities ranging from 10,000 to more than 500,000 centipoise at ambient temperatures and API gravities of less than 12. These hydrocarbons are currently produced either by steam injection in combination with mechanical pumping, mechanical pumping itself, or by mining techniques. Because of the nature of the viscous hydrocarbon materials their use in today's markets are limited. In order to develop these resources commercially it is highly desirable to provide methods for recovering, processing and transporting the viscous hydrocarbons so that they are usable commercially as a raw material for the production of various products and/or uses.

Accordingly, it is a principal object of the present invention to provide methods for the formation, processing, transportation and end use of a hydrocarbon-in-water emulsion.

Further objects and advantages of the present invention will appear hereinbelow.

SUMMARY OF THE INVENTION

The invention is drawn to methods for recovering, processing, transporting and using viscous hydrocarbons. The term "viscous hydrocarbon" as used herein means any naturally occurring crude oil or bitumens which are characterized by a viscosity of greater than or equal to 100 centipoise at a temperature of 122° F., a °API gravity of 16 or less, high metal content, high sulfur content, high asphaltene content and/or high pour point. During the production of the naturally occurring crude oil or bitumens a formation water is co-produced therewith which contains elements which are undesirable in the final emulsified product.

The present invention is drawn to a process for the preparation of a naturally occurring viscous hydrocarbon material for further processing comprising the steps of forming a first hydrocarbon-in-water emulsion (hereinafter referred to as the primary emulsion) from said naturally occurring viscous hydrocarbon material using an emulsifier wherein said hydrocarbon-in-water emulsion is characterized by a water content of at least 15 wt. %, a viscosity of no more than 5000 centipoise at 122° F. and an oil droplet size of no more than 300 microns; thereafter, if required, degassing said first hydrocarbon-in-water emulsion at a temperature of as low as 95° F. at a pressure of at least 20 psig so as to obtain a degassing efficiency of said hydrocarbon-in-water emulsion of greater than or equal to 90% so as to produce a degassed hydrocarbon-in-water emulsion having a gas content of less than 5 std. cubic ft. of gas per barrel of primary emulsion, preferably 2 std. cubic ft.; adjusting the density difference between the hydrocarbon-in-water phases of said degassed hydrocarbon-in-water emulsion such that the density difference between the phases is greater than or equal to $2\times10^{-3}$ g/cm$^3$ at a temperature T wherein the temperature T is greater than or equal to 15° C. below the cloud point of said emulsifier used in the formation of the first hydrocarbon-in-water emulsion; breaking said density adjusted hydrocarbon-in-water emulsion in a separator at said temperature T and recovering said naturally occurring hydrocarbon material separated; re-emulsifying said separated naturally occurring hydrocarbon material using an emulsifier and further conditioning same for further processing so as to form a stable secondary hydrocarbon-in-water emulsion (hereinafter referred to as the commercial emulsion sold under the trademark ORIMULSION TM) suitable for transportation; and transporting said second hydrocarbon-in-water emulsion. The breaking of the primary emulsion and reforming of the commercial ORIMULSION TM product is a critical feature of the present invention. As noted above a formation water is coproduced with the natural bitumen and/or crude oil and, as a result, it is difficult to control emulsion characteristics at the well site. By breaking the primary emulsion the ORIMULSION TM product can thereafter be formed and conditioned depending on the final use of the product. The water and emulsifier recovered from the breaking step of the process can be recycled to form the primary emulsion at the well site or, if suitable, partially used in the reformation step. The further conditioning of the commercial emulsion can include conditioning for producing a fuel which can be burned while maintaining low sulfur oxide emissions or for further refining as residual products.

In addition, the present invention includes a process for recovering a naturally occurring viscous hydrocarbon material for further processing comprising the steps of forming a first hydrocarbon-in-water emulsion from said naturally occurring viscous hydrocarbon material using an emulsifier wherein said hydrocarbon-in-water emulsion is characterized by a water content of at least 15wt. %, a viscosity of no more than 5000 centipoise at 122° F. and an oil droplet size of no more than 300 microns; and degassing if required said first hydrocarbon-in-water emulsion at a temperature of as low as 95° F. at a pressure of at least 20 psig so as to obtain a degassing efficiency of said hydrocarbon-in-water emulsion of greater than or equal to 90% so as to produce a degassed hydrocarbon-in-water emulsion having a gas content of less than 5 std. cubic ft. of gas per barrel of primary emulsion, preferably 2 std. cubic ft.

The present invention further includes a process for breaking of a hydrocarbon-in-water emulsion comprising the steps of adjusting the density difference between the hydrocarbon-in-water phases of said hydrocarbon-in-water emulsion such that the density difference between the phases is greater than or equal to $2\times10^{-3}$ g/cm$^3$ at a temperature T wherein the temperature T is greater than or equal to 15° C. below the cloud point of said emulsifier used in the formation of the first hydrocarbon-in-water emulsion; breaking said density adjusted hydrocarbon-in-water emulsion in a separator at said temperature T and recovering said naturally occurring hydrocarbon material separated; and re-emulsifying said separated naturally occurring hydrocarbon material using an emulsifier and conditioning same for further processing so as to form a stable commercial hydrocarbon-in-water emulsion suitable for transportation. The broken emulsion allows for recycling of formation water and partitioning of the emulsifier between two phases, that is, some in the hydrocarbon and some in the recycled formation water. The fact that some of the surfactant remains in the recycled formation water and separated oil means that only a make-up of surfactant is necessary when forming additional emulsions.

DETAILED DESCRIPTION

The present invention is drawn to a method for recovering a viscous hydrocarbon material from natural deposits and conditioning same as a hydrocarbon-in-water emulsion for further processing.

In practice, an oil field comprises a plurality of deep wells for removing viscous hydrocarbons from the ground. Depending on the nature of the reservoir, different lifting mechanisms may be employed for extracting the viscous hydrocarbon. For example, some wells may be injected with steam for soaking the reservoir to assist in recovering and lifting of the viscous material by mechanical pumping. Other reservoirs might simply require a deep well pump while other reservoirs might be suitable for the formation of downhole hydrocarbon-in-water emulsions in order to lift the viscous material. In most cases a combination of these methods is desirable. In accordance with the present invention it is desirable to form the emulsion as close to the well as possible so as to obtain the viscosity benefits of the emulsion.

Figure 1:
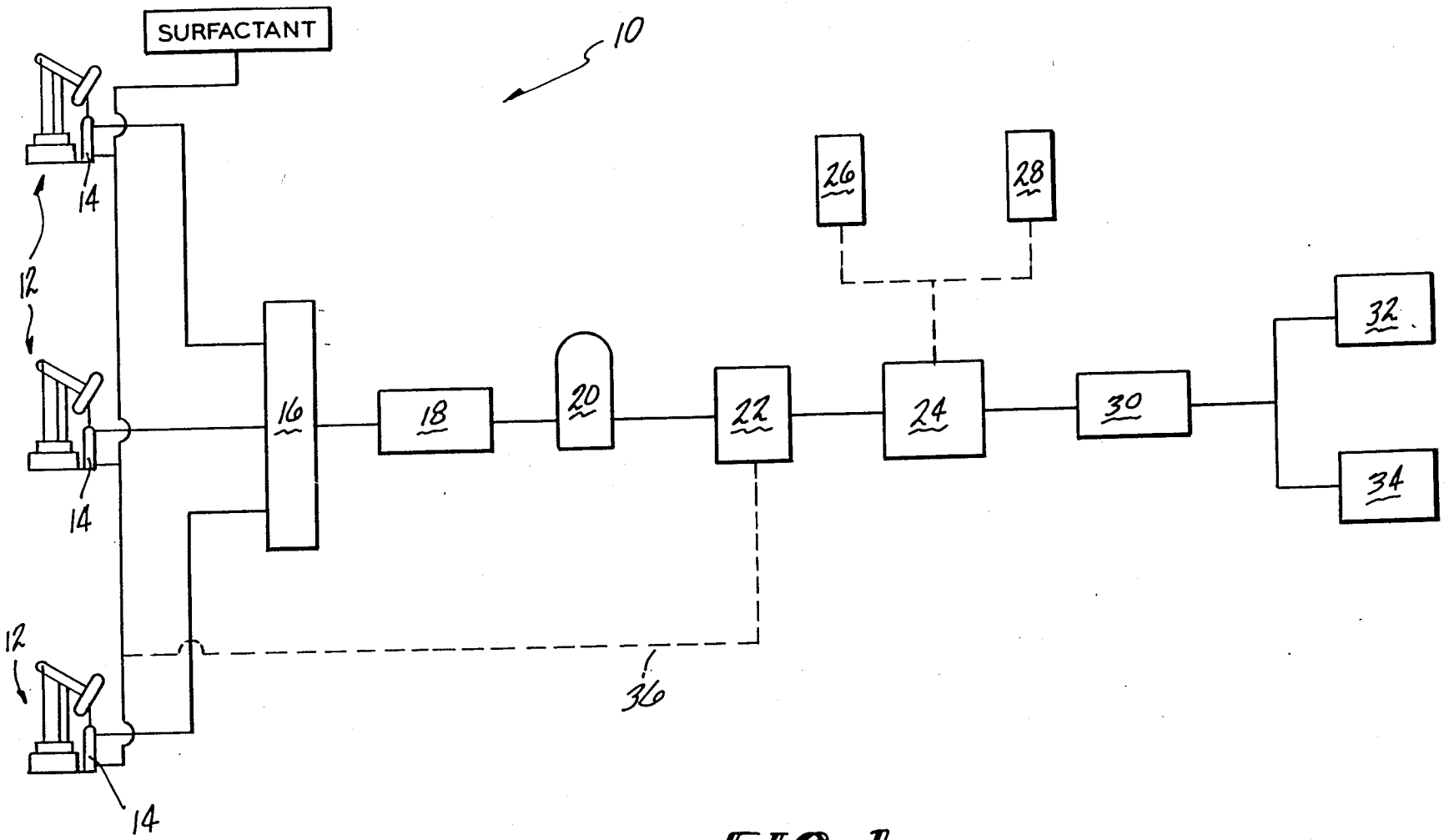
FIG. 1 is a schematic illustration of the flow scheme of the overall production process in accordance with the present invention.

FIG. 1 is a simplified schematic illustration of the flow scheme of a production facility in accordance with the present invention from well to final user. The facility 10 employs a plurality of operating wells 12 having deep well pumps 14 or the like for extracting the naturally occurring viscous hydrocarbon material from the ground. The viscous material for which the present invention is designed is characterized by the following chemical and physical properties: C wt. % of 78.2 to 85.5, H wt. % of 9.0 to 10.8, O wt. % of 0.26 to 1.1, N wt. % of 0.50 to 0.70, S wt. % of 2.00 to 4.50, Ash wt. % of 0.05 to 0.33, Vanadium, ppm of 50 to 1000, Nickel, ppm of 20 to 500, Iron, ppm of 5 to 100, Sodium, ppm of 10 to 500, Gravity, °API of −5.0 to 16.0, Viscosity (cSt), 122° F. of 100 to 5,000,000, Viscosity (cSt), 210° F. of 10 to 16,000, LHV (BTU/LB) of 15,000 to 19,000, and Asphaltenes, wt. % of 5.0 to 25.0. The viscous material recovered from the wells is fed to a flow station 16 where the material from all the wells is collected. The collected material may then be passed on for further treatment in a degasification unit 20. A static mixer 18 is provided upstream of the degassification unit to insure that a homogeneous hydrocarbon-in-water emulsion is fed to the degassification unit. In accordance with the present invention, the degassified primary emulsion is thereafter broken 22 and subsequently reformed 24 and conditioned for a particular end use. The emulsifiers 26 and additives 28 used in the reformation are determined by the particular end use of the emulsion as will be described hereinbelow. The stable reformed emulsion is then transported 30 for burning 32 or further refining 34. As noted above, the breaking of the primary emulsion and reforming of the commercial ORIMULSION TM product is a critical feature of the present invention. As noted above a formation water is coproduced with the natural bitumen and/or crude oil and, as a result, it is difficult to control emulsion characteristics at the well site. By breaking the primary emulsion the ORIMULSION TM product can thereafter be formed and conditioned depending on the final use of the product. The water and emulsifier recovered from the breaking step of the process can be recycled via line 36 for forming the primary emulsion at the well sight or, if suitable, partially used in the reformation step.

In accordance with the present invention, the material fed to the degasification unit for further treatment must be in the form of a hydrocarbon-in-water emulsion having the following characteristics: a water content of at least 15 wt. %, a viscosity of no more than 5000 centipoise at 122° F. and a droplet size of no more than 300 microns. It has been found that hydrocarbon-in-water emulsions having the foregoing characteristics can be efficiently degassed. If the viscosity of the emulsion is greater than 5000 centipoise at 122° F., the gas cannot efficiently escape. Likewise, if the oil droplet size exceeds 300 microns, the gas becomes trapped within the droplet thereby reducing degasification efficiency.

The process of the present invention is designed to insure a proper hydrocarbon-in-water emulsion fed to the degasification unit for further processing. In accordance with the present invention the emulsion can be formed at a number of locations depending on the nature of the well and the viscous hydrocarbon being produced. Initial formation of the emulsion can occur downhole, at the well head, at the flow station or any combination of the three. For example, if steam has been injected into a well reservoir, the temperature of the dead oil just after the steam soak cycle may be so high that it is impossible to effectively form an emulsion downhole. In other cases the viscosity of the crude might allow for pumping to the flow station without requiring steam injection or emulsion formation. In addition, the product from the individual wells will vary with respect to oil and gas content, amount of formation water and salt concentration. Therefore, the formation of the various emulsions must be controlled in order to insure that a homogeneous emulsified product having the characteristics set forth above, is finally produced for feed to the degasification unit. It is preferred to form the emulsion as close to the well as possible so as to take advantage of the viscosity change.

In accordance with the present invention, the hydrocarbon-in-water emulsion is formed by mixing a mixture of water plus an emulsifying agent with the viscous hydrocarbon. As noted above, in an oil field production facility the formation of the emulsion may be carried out downhole, at the well head, at the flow station or any combination of the three. The preferred emulsifier additives are selected from the group consisting of non-ionic surfactants, non-ionic surfactants plus polymers and/or biosurfactants and non-ionic surfactants plus ionics consisting of anionics and cationics and non-ionic in combination with alkalies. The preferred non-ionic surfactants include ethoxylated alkyl phenols, ethoxylated alcohols and ethoxylated sorbitan esters. Suitable polymers for use with the non-ionic surfactants include, for example, polysaccharides, polyacrylamides and cellulose derivatives. Suitable biosurfactants or biopolymers include rhamnolip and xanthan gums. Cationic surfactants are selected from the group consisting of quaternary ammonium compounds, ethoxylated amines, amido-amines and mixtures thereof. Anionic surfactants include long chain carboxylic, sulphonic salts, sulphates and mixtures thereof. Alkalies such as ammonia and monovalent hydroxides and mixtures thereof are preferred in combination with the non-ionic surfactants. In accordance with the present invention the preferred non-ionic surfactant is alkyl phenol ethoxylate having an EO content of greater than or equal to 70%. If the EO content is less than 70%, water-in-hydrocarbon emulsions tend to form. In order to demonstrate the foregoing, six emulsions were formulated from Cerro Negro Crude having an °API gravity of 8.4 employing three different non-ionic surfactants: an alkyl phenol ethoxylate having an EO content of 78%, 74% and 66%, respectively. The compositions of the emulsions and physical characteristics are set forth in Table I.

TABLE I

| Emulsion | % EO in Surfactant | Surfactant Conc., ppm | Oil/Water Ratio (w/w) | Formation T, °F. | Mean Droplet Dia., μm | Emulsion Type |
|---|---|---|---|---|---|---|
| #1 | 78 | 2000 | 60/40 | 104 | 39 | o/w |
| #2 | 78 | 2000 | 80/20 | 140 | 40 | o/w |
| #3 | 74 | 2000 | 60/40 | 104 | 47 | o/w |
| #4 | 74 | 2000 | 60/40 | 140 | 61 | o/w |
| #5 | 66 | 2000 | 60/40 | 104 | 58 | o/w |
| #6 | 66 | 2000 | 60/40 | 140 | | w/o |

As can be seen from Table I, as the EO content of the emulsifier decreases, the diameter of the oil droplet increases. Likewise, as the temperature and oil content of the emulsion increases the size of the oil droplet increases. Emulsion #6 could not be formed as a hydrocarbon-in-water emulsion due to the low EO content of the emulsifier but rather resulted in a water-in-oil emulsion.

It has been found that the addition of salt has an effect on emulsion formation in that the addition of salt allows a reduction in surfactant concentration while still maintaining the necessary emulsion characteristics. To demonstrate the foregoing, six emulsions were formed employing Hamaca Crude having an °API gravity of 10.5 employing the preferred non-ionic surfactant of the present invention, an alkyl phenol ethoxylate having an EO content of 78%. Salt in the form of NaCl was added to the aqueous phase of three of the emulsions. Table II sets forth the composition and physical properties of the emulsions.

TABLE II

| Emulsion | % EO in Surfactant | NaCl Conc., ppm | Surfactant Conc., ppm | Oil/Water Ratio (w/w) | Formation T, °F. | Mean Droplet Dia., μm | Emulsion Type |
|---|---|---|---|---|---|---|---|
| #1 | 78 | — | 1500 | 60/40 | 77 | 63 | o/w |
| #2 | 78 | — | 1000 | 60/40 | 77 | 67 | o/w |
| #3 | 78 | — | 500 | 60/40 | 77 | 73 | o/w |
| #4 | 78 | 20,000 | 1500 | 60/40 | 77 | 68 | o/w |
| #5 | 78 | 20,000 | 1000 | 60/40 | 77 | 66 | o/w |
| #6 | 78 | 20,000 | 500 | 60/40 | 77 | 65 | o/w |

It is clear from Table II that the addition of salt does not have an adverse effect on emulsion formation and oil droplet size.

In addition, it has been found that when a biopolymer is used in combination with the preferred non-ionic surfactant of the present invention the amount of surfactant required to form the desired emulsion is reduced. Table III demonstrates the foregoing when xanthan gum is used as the biopolymer.

TABLE III

| Emulsion | % EO in Surfactant | Surfactant Conc., ppm | Biopolymer Conc., ppm | Oil/Water Ratio (w/w) | Formation T, °F. | Mean Droplet Dia., μm | Emulsion Type |
|---|---|---|---|---|---|---|---|
| #1 | 78 | 500 | 500 | 60/40 | 104 | 41 | o/w |
| #2 | 78 | 230 | 200 | 60/40 | 104 | 66 | o/w |
| #3 | 78 | 230 | — | 60/40 | 104 | | w/free crude |
| #4 | 78 | 150 | — | 60/40 | 104 | | w/o |

As can be seen from Table III the biopolymer aids in the formation of the emulsion. Emulsion #3 above contained free crude oil and therefore is unsuitable for purposes of the present invention.

Table IV shows the properties obtained when employing alkalies with and without salt addition to form emulsions with Cerro Negro Crude having a °API gravity of 8.4. The alkali employed was $NH_4OH$.

TABLE IV

| Additive | pH | NaCl, Conc., ppm | Oil/Water Ratio (w/w) | Formation T, °F. | Mean, Droplet Dia., μm | Emulsion Type |
|---|---|---|---|---|---|---|
| $NH_4OH$ | 9.5 | — | 70/30 | 104 | — | no emulsion |
| $NH_4OH$ | 11.0 | — | 70/30 | 104 | 57 | o/w |
| $NH_4OH$ | 11.4 | — | 70/30 | 104 | 27 | o/w |
| $NH_4OH$ | 12.0 | — | 70/30 | 104 | — | w/o |
| $NH_4OH$ | 9.5 | — | 70/30 | 140 | — | no emulsion |
| $NH_4OH$ | 11.2 | — | 70/30 | 140 | 66 | o/w |
| $NH_4OH$ | 11.4 | — | 70/30 | 140 | 33 | o/w |
| $NH_4OH$ | 12 | — | 70/30 | 140 | — | w/o |
| $NH_4OH$ | 10.6 | 10,000 | 70/30 | 104 | — | no emulsion |
| $NH_4OH$ | 11.1 | 10,000 | 70/30 | 104 | 44 | o/w |
| $NH_4OH$ | 11.2 | 10,000 | 70/30 | 104 | — | w/o |
| $NH_4OH$ | 9.5 | — | 74/26 | 77 | — | no emulsion |
| $NH_4OH$ | 12.9 | — | 74/26 | 77 | — | no emulsion |
| $NH_4OH$ | 9.5 | — | 74/26 | 104 | — | no emulsion |
| $NH_4OH$ | 12.5 | — | 74/26 | 104 | — | no emulsion |
| $NH_4OH$ | 9.5 | — | 74/26 | 140 | — | no emulsion |
| $NH_4OH$ | 12.5 | — | 74/26 | 140 | — | no emulsion |
| $NH_4OH$ | 9.5 | 10,000 | 74/26 | 140 | — | no emulsion |
| $NH_4OH$ | 12.5 | 10,000 | 74/26 | 140 | — | no emulsion |

As can be seen from Table IV the amount of $NH_4OH$ added is critical to the formation of the desired emulsion. In order to form the emulsion $NH_4OH$ must be added in an amount sufficient to adjust the pH of the emulsion to a level of 10 to 12, preferably 11 to 11.5. In addition, it can be seen that high salt levels have an adverse effect on emulsion formation.

It has been found that the use of a small concentration of the preferred non-ionic surfactant used in combination with the $NH_4OH$ additive greatly improves the pH range at which usable emulsions are formed. Table V shows the results of emulsions made employing the Cerro Negro Crude of Table IV.

TABLE V

| Additive | % EO in Surfactant | Surfactant Conc., ppm | pH | Oil/Water Ratio (w/w) | Formation T, °F. | Mean Droplet Dia., μm | Emulsion Type |
|---|---|---|---|---|---|---|---|
| $NH_4OH$ | 78 | 250 | 9.9 | 74/26 | 104 | 70 | o/w |
| $NH_4OH$ | 78 | 250 | 11.3 | 74/26 | 104 | 23 | o/w |
| $NH_4OH$ | 78 | 250 | 12.3 | 74/26 | 104 | — | w/o |
| $NH_4OH$ | 78 | 500 | 9.9 | 74/26 | 104 | 60 | o/w |
| $NH_4OH$ | 78 | 500 | 11.3 | 74/26 | 104 | 24 | o/w |
| $NH_4OH$ | 78 | 500 | 12.3 | 74/26 | 104 | — | w/o |
| $NH_4OH$ | 78 | 1000 | 9.9 | 74/26 | 104 | 48 | o/w |
| $NH_4OH$ | 78 | 1000 | 12.3 | 74/26 | 104 | 68 | o/w |

Again, when an alkali is used in combination with a non-ionic surfactant suitable emulsions can be produced.

The foregoing examples demonstrate the effect of various additions on emulsion formation. Due to the expensive nature of many surfactants it is greatly beneficial to limit the concentration of additions of same.

Figure 2:
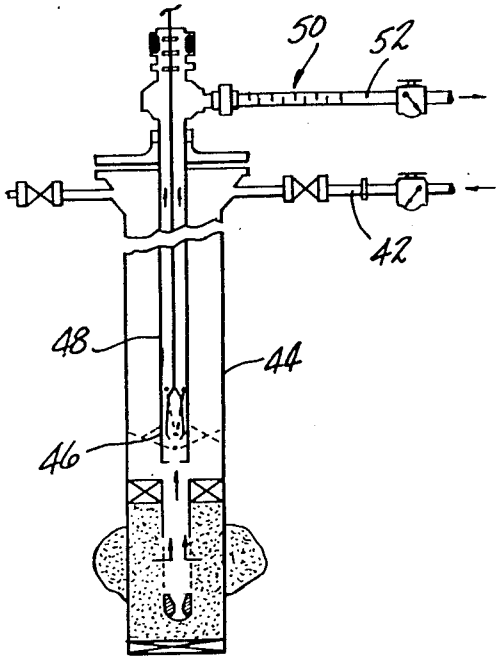
FIG. 2 is an illustration of a first embodiment for forming a hydrocarbon-in-water emulsion.

In accordance with the present invention, when the emulsion is made at the well site, the emulsion can be produced in a number of ways as schematically illustrated in FIGS. 2 through 5. For example, as illustrated in FIG. 2, the emulsifier plus water can be injected downhole via line 42 into the well casing 44 below the submersible pump 46 for forming the emulsion which is pumped up the production tube 48. A static mixer 50 may be employed in delivery line 52, and is in fact preferred, for homogenizing the emulsion delivered from production tube 48. Table VI sets forth the results obtained in forming downhole emulsions in accordance with the scheme of FIG. 2 with and without use of the static mixer 50. The emulsifier employed was the preferred non-ionic surfactant of the present invention, an alkyl phenol ethoxylate. The °API gravity of the crude was less than 16.

TABLE VI

| Static Mixer | Flow Rate bbl/day | % $H_2O$ | Surfactant Conc., ppm | Mean Droplet (Dia., μm) | Eff, % |
|---|---|---|---|---|---|
| No | 207 | 49 | 3400 | 51 | 78 |
| No | 264 | 42 | 2600 | | |
| No | 285 | 40 | 2500 | | |
| Yes | 267 | 31 | 2800 | 42 | 74 |
| Yes | 315 | 29 | 2200 | | |
| Yes | 298 | 30 | 2400 | | |

As can be seen from Table VI the use of a static mixer results in a smaller particle size emulsion. Suitable static mixers for this purpose include, for example, mixers manufactured by Sulzer Bros. and sold under the SULZER Trademark.

Figure 3:
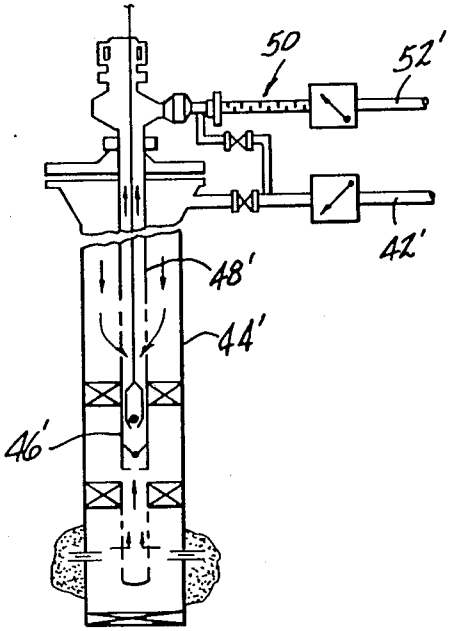
FIG. 3 is an illustration of a second embodiment for forming a hydrocarbon-in-water emulsion.

FIG. 3 illustrates an alternative scheme for downhole emulsion wherein the emulsifier-water solution is injected via line 42' into the well casing 44' above the pump 46' and the emulsion is pumped up the production tube 48' and out delivery 52' which may be provided with a static mixer 50'. Table VII sets forth the results obtained employing the scheme of FIG. 3 using the same surfactant and crude noted above with reference to FIG. 2.

TABLE VII

| Static Mixer | Pressure, psi | Formation T, °F. | Flow Rate bbl/day | % $H_2O$ | Surfactant Conc. (ppm) | Mean Droplet Dia., μm | Eff, % |
|---|---|---|---|---|---|---|---|
| No | 52 | 92 | 277 | 42 | 6109 | 200 | 52 |
| No | 52 | 92 | 264 | 47 | 6313 | 200 | |
| Yes | 97 | 91 | 209 | 47 | 3846 | 63 | 43 |
| Yes | 86 | 87 | 218 | 38 | 3661 | | |
| Yes | 71 | 94 | 252 | 40 | 3190 | | |

Again it can be seen that the use of a static mixer improves the droplet size of the oil droplets. In addition, it can be seen that the scheme of FIG. 3 does not result in the formation of emulsion droplet sizes as small as that of the FIG. 2 scheme. Likewise pumping efficiency is inferior.

Figure 4:
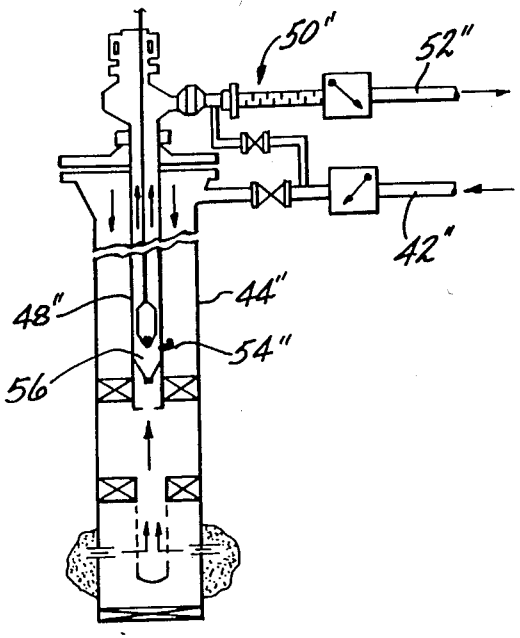
FIG. 4 is an illustration of a third embodiment for forming a hydrocarbon-in-water emulsion.

A further alternative for downhole emulsion is shown in FIG. 4 wherein the surfactant-water solution is injected into the pump casing between the stationary valve and the traveling valve, see copending application Ser. No. 095,569 filed Sept. 11, 1987, which is incorporated herein by reference. With reference to FIG. 4 the emulsifier solution is injected via line 42" into well casing 44" through check valve 54 into pump casing 56 where it mixes with the crude to form an emulsion. The emulsion is pumped up production tube 48" and out delivery line 52". Again a static mixer 50" may be provided proximate to the well head. Table VIII sets forth the emulsions obtained using the scheme of FIG. 4.

TABLE VIII

| Static Mixer | Pressure, psi | Formation T, °F. | Flow Rate bbl/day | % $H_2O$ | Surfactant Conc., ppm | Mean Droplet Dia., μm | Eff, % |
|---|---|---|---|---|---|---|---|
| No | 50 | 90 | 285 | 40 | 2400 | 45 | 88 |
| No | 40 | 94 | 268 | 42 | 3400 | | |
| No | 45 | 95 | 295 | 39 | 3100 | | |
| Yes | 50 | 94 | 306 | 31 | 3100 | 46 | 85 |
| Yes | 59 | 93 | 254 | 35 | 3600 | | |
| Yes | 52 | 100 | 233 | 40 | 2400 | | |

In this case the static mixer did not improve the particle size of the emulsion; however, the efficiency for this scheme is superior.

In either of the schemes illustrated in FIGS. 3 and 4 the emulsion can be made at the well head by injecting the emulsifier-water solution via line 28 upstream of static mixer 20 rather than injecting downhole. Table IX sets forth the results obtained for such a scheme where the emulsion is formed at the well head employing a static mixer.

TABLE IX

| Flow Rate bbl/day | % $H_2O$ | Surfactant Conc., ppm | Mean Droplet (Dia., μm) | Eff, Ave. |
|---|---|---|---|---|
| 284 | 36 | 4600 | 58 | 55% |
| 331 | 37 | 2000 | | |
| 286 | 35 | 2300 | | |
| 300 | 28 | 2200 | | |

As can be seen from Table IX, while the droplet size of the emulsion is quite acceptable the well efficiency is not as good as with the other schemes.

From the foregoing, it is seen that the scheme of FIG. 4 is preferred.

The product of the production wells, whether in the form of an hydrocarbon-in-water emulsion or other form, are delivered via the production lines to the flow station where it is collected. The volume of the crude being pumped from the well is calculable in a known manner. Ideally, the amount of emulsifier and water added to the individual wells in the field is controlled so as to obtain the proper oil/water ratio and emulsifier concentration in the flow station thereby assuring the proper emulsion characteristics for degassing as set forth above. This product is called the primary hydrocarbon-in-water emulsion. If necessary, additional emulsifiers and/or water may be added at the flow station.

In accordance with the present invention, the primary emulsion from the flow station is fed to the degasification unit through a static mixer. The static mixer insures that a homogeneous hydrocarbon-in-water emulsion is fed to the degasification unit. As previously noted, the emulsion fed to the degasification unit should have the following characteristics and properties: a water content of at least 15 wt. %, a viscosity of no more than 5000 centipoise at 122° F. and a droplet size of no more than 300 microns. By degassing a hydrocarbon-in-water emulsion greater degassing efficiency is realized at lower degassing temperatures than previously obtainable in the prior art. Ninety percent degassing efficiency is desired. To demonstrate the foregoing, Cerro Negro crude having 8.4 °API gravity was degassed in the conventional manner employing a diluent and compared to the degassing of a hydrocarbon-in-water emulsion of the same crude in the conventional manner. The results are set forth below in Table X.

TABLE X

| Formation T, °F. | P, psi | % Diluent | % $H_2O$ | Eff., % |
|---|---|---|---|---|
| 140 | 70 | 28 | — | 71 |
| 140 | 60 | 29 | — | 83 |
| 140 | 50 | 29 | — | 91 |
| 160 | 70 | 27 | — | 74 |
| 160 | 60 | 29 | — | 87 |
| 160 | 50 | 30 | — | 96 |
| 180 | 70 | 30 | — | 77 |
| 180 | 60 | 29 | — | 92 |
| 180 | 50 | 30 | — | 97 |
| 95 | 60 | — | 36.8 | 88 |
| 95 | 30 | — | 56.0 | 87 |
| 95 | 60 | — | 33.0 | 90 |
| 120 | 55 | — | 32.0 | 90 |
| 120 | 40 | — | 38.0 | 94 |
| 120 | 60 | — | 34.0 | 91 |
| 140 | 55 | — | 35.0 | 91 |
| 140 | 40 | — | 40.2 | 94 |
| 140 | 60 | — | 35.6 | 91 |
| 160 | 55 | — | 36.3 | 93 |
| 160 | 40 | — | 37.3 | 95 |

From the foregoing it can be seen that the oil-in-water emulsion can be efficiently degassed at much lower temperatures than the diluted crude. As the use of diluents and elevated temperatures add cost to the degassing operation, the degassing of emulsions is preferred.

In accordance with the present invention, the degassed primary emulsion from the degassing unit is pumped to a mainstation or terminal where the emulsion is broken and thereafter reformed and reformulated depending on the final use of the crude or bitumen, be it for refinery use or direct combustion.

Figure 5:
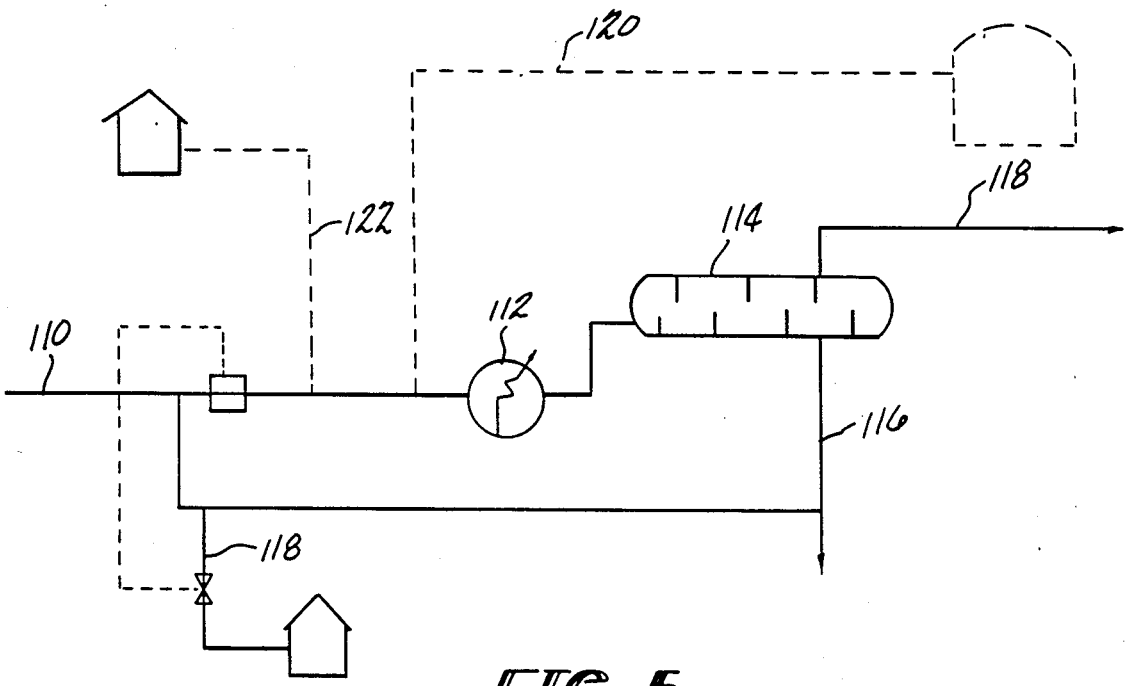
FIG. 5 is a schematic illustration showing the process for breaking a hydrocarbon-in-water emulsion in accordance with the present invention.
Figure 6:
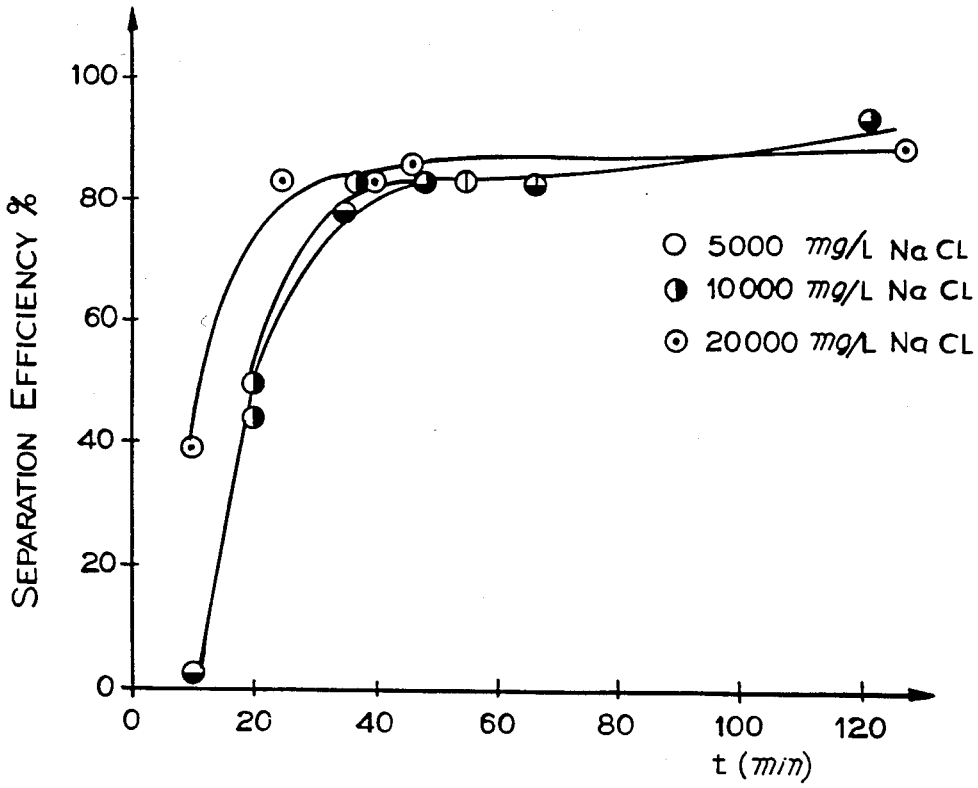
FIGS. 6–12 are graphs illustrating the effect of salt concentration, temperature and de-emulsifiers on the breaking of hydrocarbon-in-water emulsions.
Figure 7:
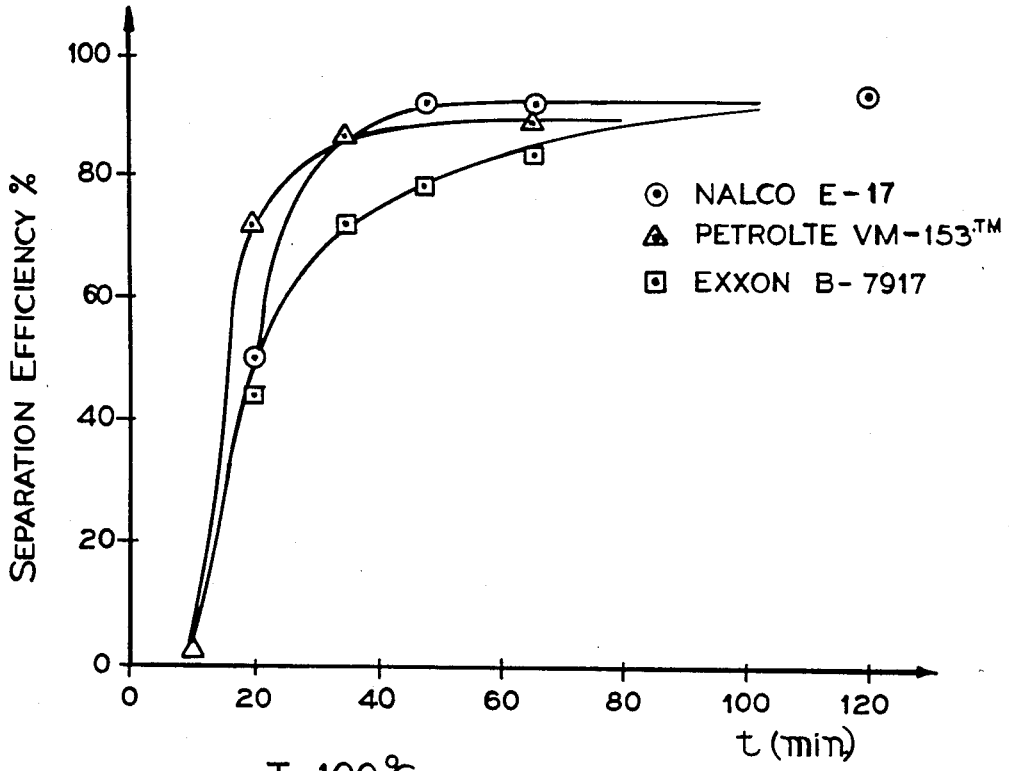
Figure 8:
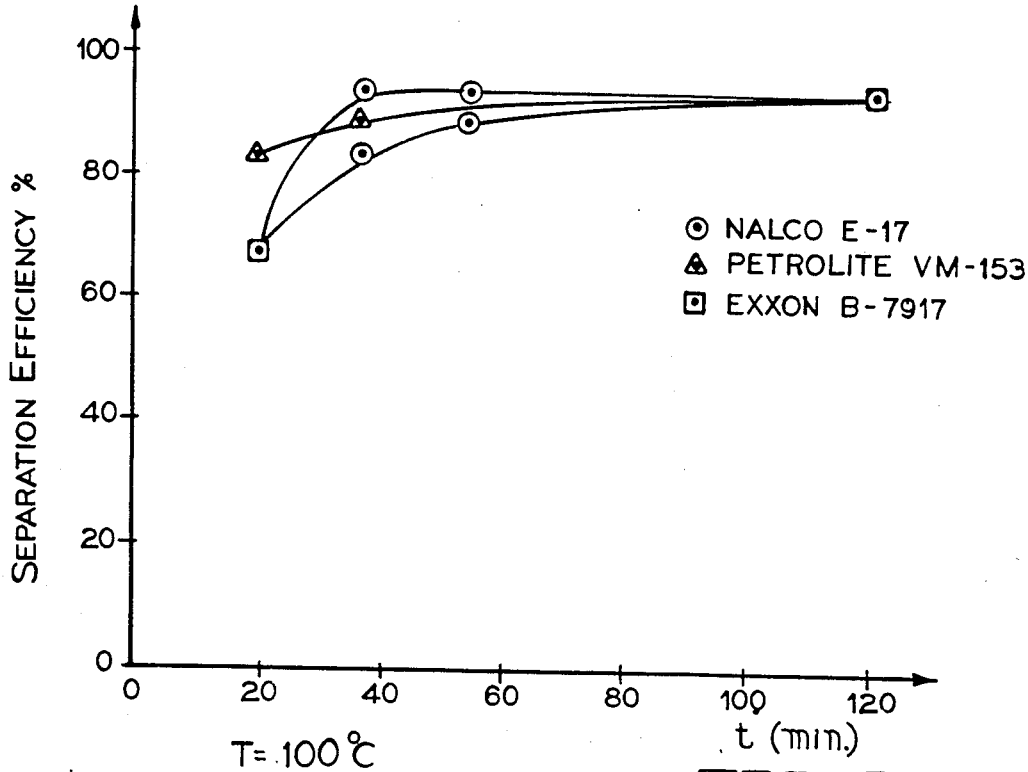
Figure 9:
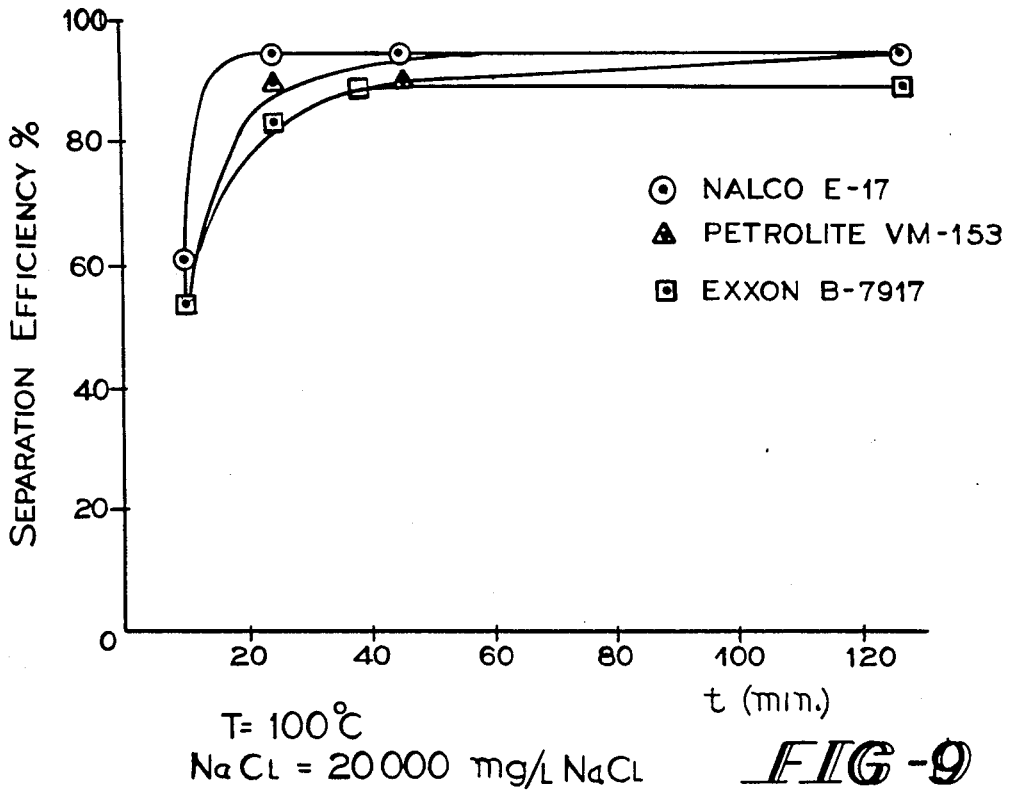
Figure 10:
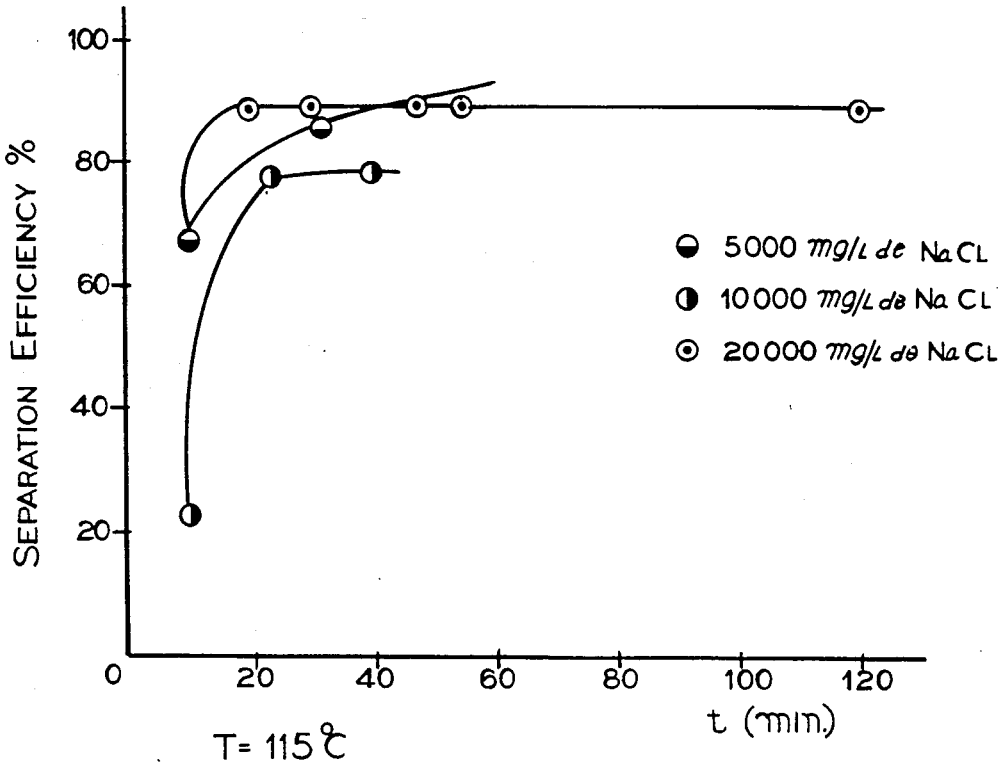
Figure 11:
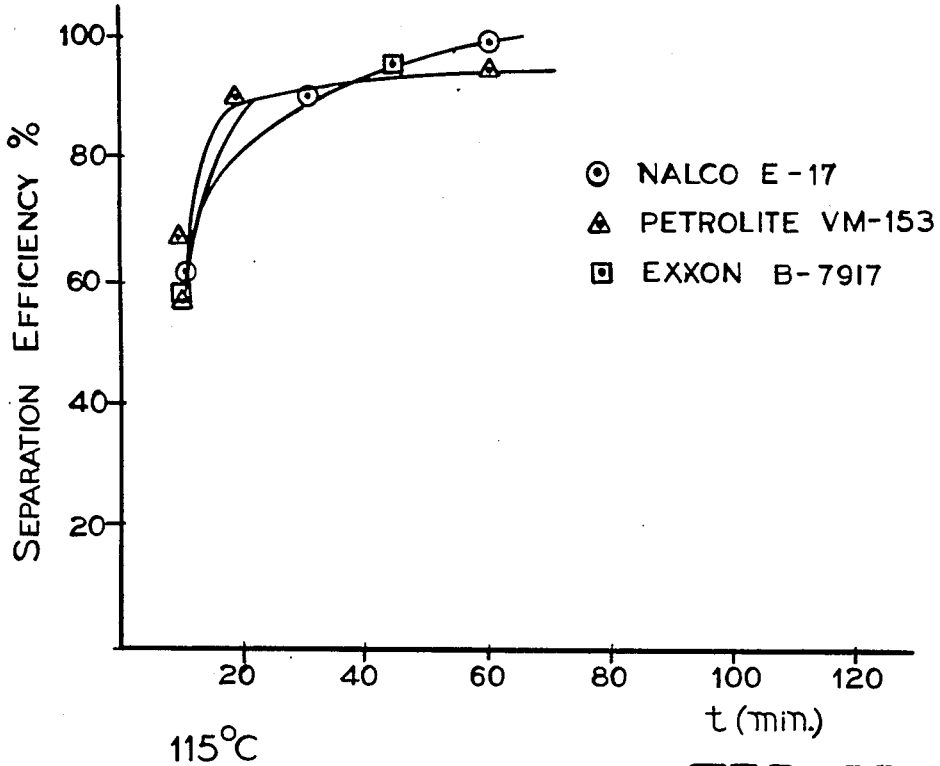
Figure 12:
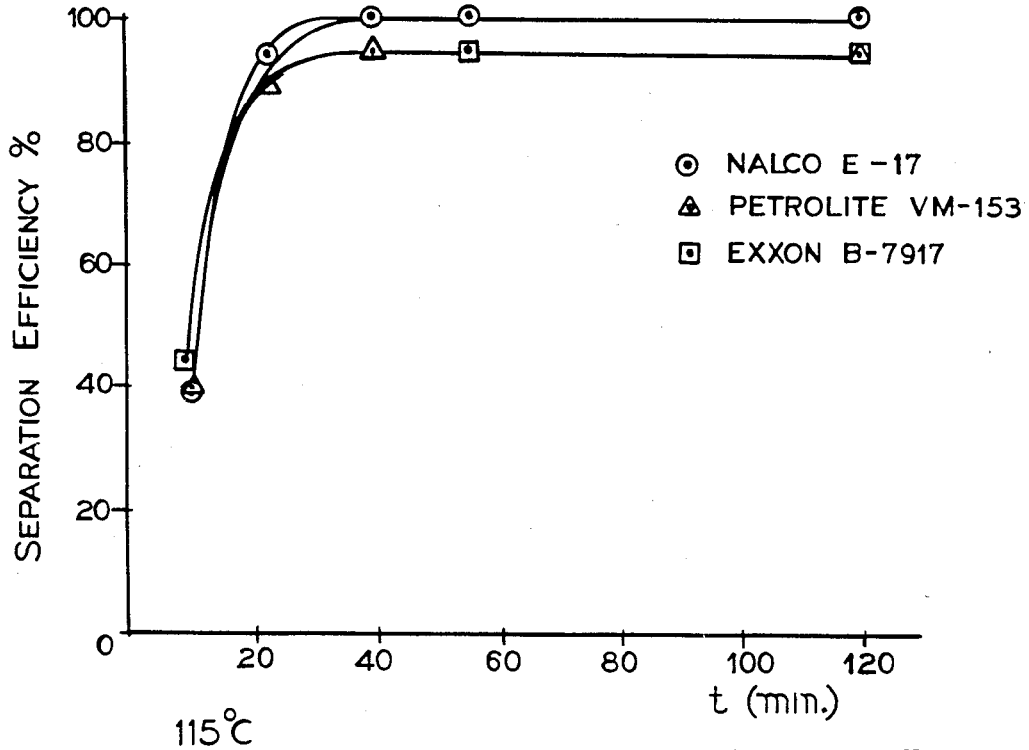

FIG. 5 is a detailed schematic illustration of the process for breaking the hydrocarbon-in-water emulsion in accordance with the present invention. Depending on the type of surfactant employed in forming the primary emulsion the steps for breaking the emulsion will differ. The hydrocarbon-in-water emulsion is delivered via line 110 to a heater 112 and thereafter to a separator 114. The separator 114 can take the form of a mechanical separator, an electrostatic separator or, preferably, a combination of mechanical-electrostatic separator. In order to insure efficient separation of the crude and water it has been found that it is necessary that the emulsion fed to the heater 112 be characterized by a critical density difference between the crude and water phases. The density difference between the crude and water phases must be greater than or equal to $2\times10^{-3}$ g/cm$^3$ at the work temperature (T) of the separator, that is, the temperature at which separation must occur where the work temperature T is defined as greater than or equal to 15° C. under the cloud point of the surfactant used in the formation of the emulsion. Thus, if the cloud point of the surfactant is, for example, 212° F. the temperature T must be greater than or equal to 185° F. The density difference is controlled by either the addition of salt to the emulsion or by adding a diluent to the emulsion or by a combination of the two. In addition, in the case of when a non-ionic surfactant is used to form the primary emulsion, a de-emulsifier may optionally be added. In the case of an ionic surfactant a de-emulsifier is required to adjust the pH of the emulsion. Suitable de-emulsifiers include salts of anionics such as salts of $Ca^{++}$, $Mg^{++}$, $Al^{+++}$ and cationics such as $SO_4^{=}$ and $HPO_3^{=}$. With reference to FIG. 5, salt water is added via line 118 while diluent can be added via line 120. The de-emulsifier can also be added in line 122 upstream of the heater 112. The conditioned emulsion is then fed to heater 112 and from there to separator 114 where the emulsion is broken. The water containing some surfactant is recycled via line 116 while the oil containing some surfactant is taken off via line 118 to a further station in FIG. 1 where the final ORIMULSION TM emulsion product will be formed. ORIMULSION TM is a trademark of Intevep, S. A.

FIGS. 6 through 12 are graphs illustrating the effect of salt concentration, temperature and the use of de-emulsifiers on the breaking of hydrocarbon-in-water emulsions formed from 8.40 °API Cerro Negro crude. The surfactant employed was alkyl phenol ethoxylate having an EO content of 74% and a cloud point of 219° F. The oil-water ratio was between about 55/45 to 65/35 with an oil droplet size of less than 100 microns. With reference to FIGS. 6 through 12, it is clear that an increase in salt concentration increases separation efficiency, see FIG. 6. Likewise, the temperature at which the separation step is carried out affects separation efficiency. A comparison of FIGS. 6 and 10 demonstrates that higher separator temperature T improves separation efficiency. This is also true when one compares FIGS. 7 through 9 with FIGS. 11 and 12. The use of de-emulsifiers slightly improves the efficiency when used in combination with salts at higher temperatures T.

TABLE XI

| Test No. | % $H_2O$ | Formation T, °F. | Pressure (psig) | Res. Time (hr) | Eff. of Sep. (%) |
|---|---|---|---|---|---|
| 1 | 38 | 248 | 18 | 8 | 53.2 |
| 2 | 40 | 241 | 24 | 9 | 76.4 |
| 3 | 41 | 242 | 30 | 8 | 79.8 |
| 4 | 44 | 246 | 35 | 7 | 83.1 |
| 5 | 42 | 239 | 40 | 7 | 92.4 |

TABLE XI-continued

| Test No. | % $H_2O$ | Formation T, °F. | Pressure (psig) | Res. Time (hr) | Eff. of Sep. (%) |
|---|---|---|---|---|---|
| 6 | 43 | 242 | 43 | 8 | 94.8 |

As can be seen from Table XI, as the operating pressure increases separation efficiency increases. As noted above when an ionic surfactant is used as the emulsifier either alone or in combination with a non-ionic surfactant, it is necessary to employ a de-emulsifier to vary the pH of the primary emulsion in order to have an efficient breaking of same. The de-emulsifier may be in the form of salts of $Ca^{++}$, $Mg^{++}$, $Al^{+++}$, $SO_4^{=}$, $HPO_3^{=}$ or combinations thereof.

As noted above the separator used for breaking the primary emulsion may be in the form of a mechanical separator, an electrostatic separator or a combination of the two, with the combination of the two being preferred. In order to demonstrate the foregoing, an emulsion having an oil/water ratio of 65/35 with salt concentation of 20,000 mg/l of sodium chloride was processed in the separator at a pressure of 100 psi employing a de-emulsifier sold under the trademark VISCO E-17 TM by Nalco. Table XII below summarizes the separation operation running four tests wherein tests 1 and 3 employed a combination mechanical-electrostatic separator and tests 2 and 4 employed a mechanical separator.

TABLE XII

| Test No. | Working T, °F. | Res. Time (hr) | De-emulsifier Conc., ppm | Voltage (V) | Eff. of Sep. (%) |
|---|---|---|---|---|---|
| 1 | 240 | 1.6 | 50 | 6 | 91.7 |
| 2 | 240 | 1.6 | 50 | 0 | 68.0 |
| 3 | 240 | 4.0 | 50 | 6 | 93 |
| 4 | 240 | 4.0 | 50 | 0 | 82 |

As can be seen from Table XII, the separation efficiency is far superior using the combination mechanical-electrostatic separator.

As previously noted, the main reason for breaking and reforming the emulsion is to insure a properly conditioned emulsion for further processing. This is necessary due to the presence of formation water, salts and other elements which are present and co-produced with the viscous hydrocarbon production. Once the primary emulsion is broken, the separated water and surfactant can be recycled (via line 36 in FIG. 1) to the well head or other location for forming the primary emulsion. Likewise removed salts can be recycled for example to adjust the density of the primary emulsion prior to breaking. Thus, the process of the present invention is a semi-closed system which allows for reuse of expensive surfactants and the like.

Once the primary emulsion is broken, the separated crude oil is subjected to reformation process wherein the crude is re-emulsified and conditioned for further use, for example, shipment to a power plant for burning or to a refinery for further processing.

The emulsion formed in the reformation section, hereinafter referred to as ORIMULSION TM should be characterized by a water content of about 15 to 40 wt. %, preferably 24 to 32 wt. % and an oil content of between 60 to 85 wt. %, preferably 68 to 76 wt. %. The ORIMULSION TM hydrocarbon-in-water emulsion should have an apparent viscosity of less than or equal to 5000 centipoise at 122° F. and a mean droplet size of between 5 to 50 microns, preferably 10 to 20 microns. In addition, the commercial emulsion must exhibit stability for storage and tanker transportation as well as pipeline transportation. The stability of ORIMULSION TM commercial emulsion will be demonstrated hereinafter. If the ORIMULSION TM is to be transferred to a facility for direct burning of same, the emulsifier added in the reformation station should be a non-ionic surfactant selected from those non-ionic surfactants set forth above. It is critical that the surfactant used for the formation of emulsion which is to be directly burned is non-ionic because of the fact that non-ionic surfactants are not salt sensitive. It has been found, in accordance with the present invention, that the addition of certain additives to the hydrocarbon-in-water emulsion prohibits the formation of sulfur oxides during the combustion of the ORIMULSION TM which is highly desirable. The preferred additives are water soluble salts and are selected from the group of salts consisting of $Na^+$, $K^+$, $Li^+$, $Ca^{++}$, $Ba^{++}$, $Mg^{++}$, $Fe^{+++}$ and mixtures thereof. The most preferred additives are the polyvalent metals which, because of their high melting points, produce no slag when burned. In order to insure that these additives remain active in the emulsion, a non-ionic surfactant is required. The amount of surfactant employed in the formation of the ORIMULSION TM hydrocarbon-in-water emulsion is previously demonstrated with regard to the formation of the primary emulsion above. The water soluble additives should be added to the emulsion in a molar ratio amount of additive to sulfur in the hydrocarbon so as to obtain $SO_2$ emissions upon combustion of the ORIMULSION TM hydrocarbon-in-water emulsion of less than or equal to 1.5 LB/MMBTU. It has been found that in order to obtain the desired emissions level, the additive must be present in a molar ratio of additive to sulfur of greater than or equal to 0.050, preferably 0.100, in the ORIMULSION TM hydrocarbon-in-water emulsion. While the level of additive, in order to obtain the desired $SO_2$ emissions, depends on the particular additive or combination of additives employed, it has been found that a molar ratio of at least 0.050 of additive to sulfur is required.

As noted above, it is preferred that the emulsifier additive be a non-ionic surfactant and it is preferred that the additive be a non-ionic surfactant selected from the group consisting of ethoxylated alkyl phenols, ethoxylated alcohols, ethoxylated sorbitan esters and mixtures thereof.

It has been found that the content of the sulfur capturing additive in the hydrocarbon-in-water emulsion has a great effect on its combustion characteristics, particularly on sulfur oxide emissions. It is believed that, due to high interfacial bitumen-water surface to volume ratio, the additives react with sulfur compounds present in the fuel to produce sulfides such as sodium sulfide, potassium sulfide, magnesium sulfide and calcium sulfide, etc. During combustion, these sulfides are oxidized to sulfates thus fixing sulfur to the combustion ashes and thus preventing sulfur from going into the atmosphere as part of the flue gases. The amount of additive required depends on (1) the amount of sulfur in the hydrocarbon, and (2) the particular additive being used.

Once the hydrocarbon-in-water emulsion is conditioned it is ready for transporting and burning. Any conventional oil gun burner can be employed such as an internal mixing burner or other twin fluid atomizers.

Atomization using steam or air under the following operating conditions is preferred: fuel temperature (°F.) of 60 to 176, preferably 60 to 140, steam/fuel ratio (wt/wt) of 0.05 to 0.5, preferably 0.05 to 0.4, air/fuel ratio (wt/wt) of 0.05 to 0.4, preferably 0.05 to 0.3, and steam pressure (Bar) of 1.5 to 6, preferably 2 to 4, or air pressure (Bar) of 2 to 7, preferably 2 to 4. Under these conditions excellent atomization and efficient combustion was obtained coupled with good flame stability.

The superior results obtained from burning the ORIMULSION TM hydrocarbon-in-water emulsion in accordance with the present invention are demonstrated by the following examples:

EXAMPLE I

In order to demonstrate the stability of the commercial oil-in-water emulsions of the present invention and the effect of the additive of the present invention on the combustion characteristics of the hydrocarbon-in-water emulsions of the present invention, seven bitumen in water emulsions were prepared having the compositional characteristics set forth below in Table XIII.

TABLE XIII

| | FUEL CHARACTERISTICS | | | | | | |
|---|---|---|---|---|---|---|---|
| | BASELINE EMULSION | EMULSION #1 | EMULSION #2 | EMULSION #3 | EMULSION #4 | EMULSION #5 | EMULSION #6 |
| ADDITIVE/SULFUR (MOLAR/RATIO) | 0 | 0.011 | 0.019 | 0.027 | 0.036 | 0.097 | 0.035 |
| Na (% molar) | 0 | 95.4 | 95.4 | 95.4 | 95.4 | 95.4 | 95.4 |
| K (% molar) | 0 | 0.7 | 0.7 | 0.7 | 0.7 | 0.7 | 0.7 |
| Li (% molar) | 0 | 1.4 | 1.4 | 1.4 | 1.4 | 1.4 | 1.4 |
| Mg (% molar) | 0 | 2.5 | 2.5 | 2.5 | 2.5 | 2.5 | 2.5 |
| LHV (BTU/LB) | 13337 | 13277 | 13158 | 13041 | 12926 | 12900 | 12900 |
| VOL % OF BITUMEN | 78.0 | 77.9 | 77.7 | 77.5 | 77.3 | 70 | 70 |
| VOL % OF WATER | 22.0 | 22.1 | 22.3 | 22.5 | 22.7 | 30 | 30 |
| WT. % OF SULFUR | 3.0 | 3.0 | 3.0 | 3.0 | 2.9 | 2.7 | 2.7 |

Combustion tests were conducted under the operating conditions set forth in Table XIV.

TABLE XIV

| | OPERATING CONDITIONS | | | | | | |
|---|---|---|---|---|---|---|---|
| | BASELINE EMULSION | EMULSION #1 | EMULSION #2 | EMULSION #3 | EMULSION #4 | EMULSION #5 | EMULSION #6 |
| FEED RATE (LB/H) | 59.9 | 60.0 | 60.1 | 60.3 | 60.4 | 63.7 | 63.7 |
| THERMAL INPUT (MMBTU/H) | 0.82 | 0.82 | 0.82 | 0.82 | 0.82 | 0.82 | 0.82 |
| FUEL TEMPERATURE (°F.) | 154 | 154 | 154 | 154 | 154 | 154 | 152 |
| STEAM/FUEL RATIO (W/W) | 0.30 | 0.30 | 0.30 | 0.30 | 0.30 | 0.30 | 0.30 |
| STEAM PRESSURE (BAR) | 2.4 | 2.4 | 2.4 | 2.4 | 2.4 | 2.4 | 2.4 |
| MEAN DROPLET SIZE (μm) | 14 | 14 | 14 | 14 | 14 | 14 | 14 |

The combustion characteristics are summarized in Table XV below.

TABLE XV

| | COMBUSTION CHARACTERISTICS | | | | | | |
|---|---|---|---|---|---|---|---|
| | BASELINE EMULSION | EMULSION #1 | EMULSION #2 | EMULSION #3 | EMULSION #4 | EMULSION #5 | EMULSION #6 |
| $CO_2$ (vol. %) | 13.0 | 12.9 | 13.1 | 13.0 | 13.0 | 12.9 | 13.2 |
| CO (ppm) | 36 | 27 | 41 | 30 | 38 | 20 | 40 |
| $O_2$ (vol. %) | 3.0 | 2.9 | 3.0 | 3.0 | 3.0 | 3.0 | 3.0 |
| $SO_2$ (ppm) | 2347 | 1775 | 1635 | 1516 | 1087 | 165 | 1120 |
| $SO_2$ (LB/MMBTU) | 4.1 | 3.1 | 2.9 | 2.7 | 1.9 | 0.3 | 2.0 |
| $SO_3$ (ppm) | 10 | 9 | 8 | 8 | 5 | 5 | 5 |
| NOx (ppm) | 450 | 498 | 480 | 450 | 432 | 434 | 420 |
| *$SO_2$ REDUCTION (%) | — | 24.4 | 30.3 | 35.4 | 53.7 | 93.1 | 52.03 |
| **COMBUSTION EFFICIENCY (%) | 99.8 | 99.8 | 99.5 | 99.8 | 99.9 | 99.9 | 99.9 |

$$*SO_2\ \text{REDUCTION}\ (\%) = \frac{SO_2\ \text{BASELINE} - SO_2\ \text{EMULSION}\ \#}{SO_2\ \text{BASELINE}} \times 100$$

**BASED ON CARBON CONVERSION

Table XV clearly indicates that as the ratio of additive to sulfur increases the combustion efficiency of the emulsified hydrocarbon fuels improves to 99.9%. In addition to the foregoing, the comparative data of Table XV shows that $SO_2$ and $SO_3$ emission levels improve as the additive to sulfur ratio increases. As can be seen from emulsion No. 5, the efficiency of $SO_2$ removal is in excess of 90% at an additive to sulfur ratio of 0.097. In addition, the sulfur oxide emissions in LB/MMBTU is far less than the 1.50 LB/MMBTU obtained when burning No. 6 fuel oil. In addition, the burning of said optimized hydrocarbon-in-water emulsions leads to a substantial decrease of sulfur trioxide formation thus preventing corrosion of heat transfer surfaces due to sulfuric acid condensation, e.g., low temperature corrosion.

In addition, comparison of emulsions No. 4 and No. 6, burned with same additive to sulfur molar ratio, shows that dilution of bitumen in the aqueous phase (from 77.3 to 70.0 percent volume) has no effect on combustion characteristics while rendering equivalent $SO_2$ reduction (53.7 vs. 52.3 percent).

In addition, transportation stability tests were conducted using Emulsion No. 5. Sixteen Thousand Eighty-Eight (16,088) barrels of No. 5 Emulsion were loaded in the slop tank of an oil tanker. The volume of the slop tank was Nineteen Thousand (19,000) barrels. The tanker was at sea for twelve (12) days during which the characteristics of the emulsion were monitored. The results are set forth hereinbelow in Table XVI.

TABLE XVI

| Day | Sample | Viscosity, cP (81° C.) | % Water | Mean Droplet Dia., μm | Mean Emulsion Temp (°F.) |
|---|---|---|---|---|---|
| 0 | Top | 3760 | 26 | 28 | 118 |
| | Center | 3300 | 27 | 26 | |
| | Bottom | 3400 | 27 | 30 | |
| 2 | Top | 2670 | 26 | | 117 |
| | Center | 2670 | 26 | | |
| | Bottom | 2510 | 26 | | |
| 4 | Top | 2510 | 26 | | 115 |
| | Center | 2520 | 26 | | |
| | Bottom | 2190 | 26 | | |

TABLE XVI-continued

| Day | Sample | Viscosity, cP (81° C.) | % Water | Mean Droplet Dia., μm | Mean Emulsion Temp (°F.) |
|---|---|---|---|---|---|
| 6 | Top | 2030 | 26 | | 113 |
| | Center | 2270 | 26.5 | | |
| | Bottom | 2190 | 26.5 | | |
| 8 | Top | 2430 | 26 | | 113 |
| | Center | 2350 | 26 | | |
| | Bottom | 1380 | 27 | | |
| 12 | Top | 1620 | 27 | 29 | 113 |
| | Center | 1860 | 26.5 | 27 | |
| | Bottom | 1380 | 27.5 | 31 | |

As can be seen, the water droplet size and water content of the emulsion remain unchanged thereby demonstrating the stability of the emulsion.

EXAMPLE II

Six additional hydrocarbon-in-water emulsions were prepared employing the same bitumen of Example I. The compositional characteristics of these emulsions are set forth in Table XVII below.

TABLE XVII

| | FUEL CHARACTERISTICS | | | | | |
|---|---|---|---|---|---|---|
| | BASELINE EMULSION | EMULSION #7 | EMULSION #8 | EMULSION #9 | EMULSION #10 | EMULSION #11 |
| ADDITIVE/SULFUR (MOLAR/RATIO) | — | 0.014 | 0.027 | 0.035 | 0.044 | 0.036 |
| Na (% molar) | 0 | 95.4 | 95.4 | 95.4 | 95.4 | 95.4 |
| K (% molar) | 0 | 0.7 | 0.7 | 0.7 | 0.7 | 0.7 |
| Li (% molar) | 0 | 1.4 | 1.4 | 1.4 | 1.4 | 1.4 |
| Mg (% molar) | 0 | 2.5 | 2.5 | 2.5 | 2.5 | 2.5 |
| LHV (BTU/LB) | 13083 | 12739 | 12429 | 12119 | 11826 | 12900 |
| VOL % OF BITUMEN | 76 | 74 | 72.2 | 70.4 | 68.7 | 70 |
| VOL % OF WATER | 24 | 26 | 27.8 | 29.6 | 31.3 | 30 |
| WEIGHT % OF SULFUR | 2.9 | 2.8 | 2.8 | 2.7 | 2.6 | 2.7 |

These emulsions were combusted under the operating conditions set forth in Table XVIII.

TABLE XVIII

| | OPERATING CONDITIONS | | | | | |
|---|---|---|---|---|---|---|
| | BASELINE EMULSION | EMULSION #7 | EMULSION #8 | EMULSION #9 | EMULSION #10 | EMULSION #11 |
| FEED RATE (LB/H) | 55.1 | 56.5 | 57.8 | 59.4 | 60.9 | 63.7 |
| THERMAL INPUT (MMBTU/H) | 0.75 | 0.75 | 0.75 | 0.75 | 0.75 | 0.82 |
| FUEL TEMPERATURE (°F.) | 149 | 149 | 149 | 149 | 149 | 154 |
| STEAM/FUEL RATIO (W/W) | 0.30 | 0.30 | 0.30 | 0.30 | 0.30 | 0.30 |
| STEAM PRESSURE (BAR) | 2.4 | 2.4 | 2.4 | 2.4 | 2.4 | 2.4 |
| MEAN DROPLET SIZE (μm) | 32 | 32 | 32 | 32 | 32 | 32 |

The combustion characteristics are summarized in Table XIX.

TABLE XIX

| | COMBUSTION CHARACTERISTICS | | | | | |
|---|---|---|---|---|---|---|
| | BASELINE EMULSION | EMULSION #7 | EMULSION #8 | EMULSION #9 | EMULSION #10 | EMULSION #11 |
| $CO_2$ (vol. %) | 14.0 | 14.0 | 14.0 | 13.5 | 13.2 | 13.5 |
| CO (ppm) | 73 | 30 | 163 | 94 | 197 | 18 |
| $O_2$ (vol. %) | 3.0 | 2.7 | 2.9 | 2.9 | 3.1 | 3.0 |
| $SO_2$ (ppm) | 2133 | 1824 | 940 | 1109 | 757 | 1134 |
| $SO_2$ (LB/MMBTU) | 3.2 | 2.8 | 1.4 | 1.7 | 1.2 | 1.7 |
| $SO_3$ (ppm) | 13 | 9 | 7 | 5 | 2 | 6 |
| NOx (ppm) | 209 | 128 | 182 | 114 | 73 | 110 |
| *$SO_2$ REDUCTION (%) | — | 14.5 | 56.0 | 48.0 | 64.5 | 51.7 |
| **COMBUSTION | 99.9 | 99.8 | 99.9 | 99.8 | 99.9 | 99.9 |

TABLE XIX-continued

| | COMBUSTION CHARACTERISTICS | | | | | |
|---|---|---|---|---|---|---|
| | BASELINE EMULSION | EMULSION #7 | EMULSION #8 | EMULSION #9 | EMULSION #10 | EMULSION #11 |
| EFFICIENCY (%) | | | | | | |

$$*SO_2\ REDUCTION\ (\%) = \frac{SO_2\ BASELINE - SO_2\ EMULSION\ \#}{SO_2\ BASELINE} \times 100$$

**BASED ON CARBON CONVERSION

Again, it is clear from Table XIX that an increase in additive to sulfur ratio results in improved combustion efficiency and superior sulfur oxide emissions. Note that sodium was the primary element in the additive.

In addition, Comparison of emulsion No. 11 with emulsion No. 6 from previous example, both burned at identical thermal input (0.82 MMBTU/H), shows that the difference in mean droplet size (34 vs. 14 μm) does not affect combustion characteristics while rendering equivalent $SO_2$ captures (51.7 vs. 52.3 percent) when burned with same additive to sulfur molar ratio.

Further, a comparison of emulsions No. 9 and No. 11, shows that $SO_2$ capture does not depend on thermal input.

EXAMPLE III

Seven further hydrocarbon-in-water emulsions were prepared and the compositional characteristics of these emulsions are set forth below in Table XX.

TABLE XX

| | FUEL CHARACTERISTICS | | | | | | |
|---|---|---|---|---|---|---|---|
| | BASELINE EMULSION | EMULSION #12 | EMULSION #13 | EMULSION #14 | EMULSION #15 | EMULSION #16 | EMULSION #17 |
| ADDITIVE/SULFUR (MOLAR/RATIO) | — | 0.10 | 0.20 | 0.30 | 0.50 | 0.68 | 0.78 |
| Mg (% molar) | 0 | 99.0 | 99.0 | 99.0 | 99.0 | 99.0 | 99.0 |
| Ca (% molar) | 0 | 0.25 | 0.25 | 0.25 | 0.25 | 0.25 | 0.25 |
| Ba (% molar) | 0 | 0.25 | 0.25 | 0.25 | 0.25 | 0.25 | 0.25 |
| Fe (% molar) | 0 | 0.5 | 0.5 | 0.5 | 0.5 | 0.5 | 0.5 |
| LHV (BTU/LB) | 13086 | 12553 | 12223 | 12223 | 11706 | 11189 | 10845 |
| VOL % OF BITUMEN | 76 | 73 | 71 | 74 | 68 | 65 | 63 |
| VOL % OF WATER | 24 | 27 | 29 | 26 | 32 | 35 | 37 |
| WT. % OF SULFUR | 2.9 | 2.8 | 2.7 | 2.8 | 2.6 | 2.5 | 2.4 |

Combustion tests were run under the following operating conditions. The results are set forth in Table XXI.

TABLE XXI

| | OPERATING CONDITIONS | | | | | | |
|---|---|---|---|---|---|---|---|
| | BASELINE EMULSION | EMULSION #12 | EMULSION #13 | EMULSION #14 | EMULSION #15 | EMULSION #16 | EMULSION #17 |
| FEED RATE (LB/H) | 55.1 | 57.2 | 59.2 | 59.2 | 62 | 64.7 | 66 |
| THERMAL INPUT (MMBTU/H) | 0.75 | 0.75 | 0.75 | 0.75 | 0.75 | 0.75 | 0.75 |
| FUEL TEMPERATURE (°F.) | 149 | 149 | 149 | 149 | 149 | 149 | 149 |
| STEAM/FUEL RATIO (W/W) | 0.30 | 0.30 | 0.30 | 0.30 | 0.30 | 0.30 | 0.30 |
| STEAM PRESSURE (BAR) | 2.4 | 2.4 | 2.4 | 2.4 | 2.4 | 2.4 | 2.4 |
| MEAN DROPLET SIZE (μm) | 32 | 32 | 32 | 32 | 32 | 32 | 32 |

The combustion characteristics are summarized in Table XXII below.

TABLE XXII

| | COMBUSTION CHARACTERISTICS | | | | | | |
|---|---|---|---|---|---|---|---|
| | BASELINE EMULSION | EMULSION #12 | EMULSION #13 | EMULSION #14 | EMULSION #15 | EMULSION #16 | EMULSION #17 |
| $CO_2$ (vol. %) | 13.5 | 13.4 | 14 | 14 | 13.5 | 14 | 13.2 |
| CO (ppm) | 61 | 30 | 60 | 18 | 10 | 13 | 10 |
| $O_2$ (vol. %) | 3.0 | 3.2 | 2.9 | 2.6 | 3.2 | 2.9 | 3 |
| $SO_2$ (ppm) | 2357 | 1650 | 1367 | 1250 | 940 | 500 | 167 |
| $SO_2$ (LB/MMBTU) | 3.6 | 2.5 | 2.1 | 1.9 | 1.4 | 0.8 | 0.3 |
| $SO_3$ (ppm) | 18 | 16 | 9 | 8 | 7 | 6 | nil |
| NOx (ppm) | 500 | 510 | 400 | 430 | 360 | 240 | 218 |
| *$SO_2$ REDUCTION (%) | — | 30.0 | 42.0 | 47.0 | 60.0 | 79.0 | 93.0 |
| **COMBUSTION | 99.9 | 99.9 | 99.9 | 99.9 | 99.9 | 99.9 | 99.8 |

TABLE XXII-continued

| | COMBUSTION CHARACTERISTICS | | | | | | |
|---|---|---|---|---|---|---|---|
| | BASELINE EMULSION | EMULSION #12 | EMULSION #13 | EMULSION #14 | EMULSION #15 | EMULSION #16 | EMULSION #17 |
| EFFICIENCY (%) | | | | | | | |

$$*SO_2 \text{ REDUCTION } (\%) = \frac{SO_2 \text{ BASELINE} - SO_2 \text{ EMULSION \#}}{SO_2 \text{ BASELINE}} \times 100$$

**BASED ON CARBON CONVERSION

Table XXII again clearly indicates, as did Tables XV and XIX, that as the ratio of additive to sulfur increases the combustion efficiency of the emulsified hydrocarbon fuels improves. In addition, Table XXII clearly shows that sulfur oxide emission levels decrease as the additive to sulfur ratio increases. Again it can be seen from emulsions 16 and 17 that sulfur oxide emissions obtained are less than that attainable when burning No. 6 fuel oil. Note that magnesium was the primary element in the additive.

EXAMPLE IV

Major component of ash produced when burning these emulsified fuels such as emulsions No. 15, No. 16 and No. 17 was reported as 3 $MgO.V_2O_5$ (magnesium orthovanadate) whose melting point is 2174° F. Magnesium orthovanadate is a very well known corrosion inhibitor for vanadium attack in combustion systems. Therefore, ashes from emulsions burnt using additives consisting of elements selected from the group of $Ca^{++}$, $Ba^{++}$, $Mg^{++}$ and $Fe^{+++}$ or mixtures thereof and ashes from emulsions burnt using additives consisting of elements selected from the grouop of $Na^{+}$, $K^{+}$, $Li^{+}$ and $Mg^{++}$, where $Mg^{++}$ is the primary element will render high temperature-corrosion free combustion. Such high temperature corrosion is normally caused, in liquid hydrocarbon combustion, by vanadium low melting point compounds.

In the event the reformed emulsion is to be transported to a refinery or the like for further processing, the emulsion must be conditioned so as to avoid salt concentrations therein as the salt would lead to a corrosion problem during the refinery process. In accordance with the present invention it has been found that the preferred surfactant for use in forming the ORIMULSION TM hydrocarbon-in-water emulsion for transportation to a refinery or the like consists of a combination of a non-ionic surfactant with an alkali such as ammonia. The formation of emulsions employing the preferred non-ionic surfactant with ammonia are set forth above in Table V. As noted above, if the emulsion is to be further processed, it is desirable to remove the salts from the emulsion prior to the delivery to the refinery. The addition of ammonia as a surfactant in forming the emulsion aids in the removal of undesirable salts during the further processing of the emulsion. In addition to the foregoing, additional elements may be added to the emulsion such as corrosion inhibitors, anti-thixotropic agents and the like.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for the preparation of a naturally occurring viscous hydrocarbon material for further processing comprising the steps of:

(a) forming a first hydrocarbon-in-water emulsion from said naturally occurring viscous hydrocarbon material using an emulsifier wherein said hydrocarbon-in-water emulsion has a water content of at least 15 wt. %, a viscosity of no more than 5000 centipoise at 122° F. and an oil droplet size of no more than 300 microns;

(b) degassing said first hydrocarbon-in-water emulsion at a temperature of as low as 95° F. at a pressure of at least 20 psi so as to obtain a degassing efficiency of said hydrocarbon-in-water emulsion of greater than or equal to 90% so as to produce a degassed hydrocarbon-in-water emulsion having a gas content of less than 5 cubic ft. of gas per barrel of emulsion;

(c) adjusting the density difference between the hydrocarbon-in-water phases of said degassed hydrocarbon-in-water emulsion such that the density difference between the phases is greater than or equal to $2\times10^{-3}$ g/cm$^3$ at a temperature T wherein the temperature T is greater than or equal to 15° C. below the cloud point of said emulsifier used in the formation of the first hydrocarbon-in-water emulsion;

(d) breaking said density adjusted hydrocarbon-in-water emulsion in a separator at said temperature T and recovering said naturally occurring hydrocarbon material separated;

(e) re-emulsifying said separated naturally occurring hydrocarbon material using an emulsifier and conditioning same for further processing so as to form a stable second hydrocarbon-in-water emulsion suitable for transportation; and (f) transporting said second hydrocarbon-in-water emulsion.

2. A process according to claim 1 including the step of conditioning said re-emulsified naturally occurring hydrocarbon material for burning as a natural fuel.

3. A process according to claim 2 including forming a portion of said first hydrocarbon-in-water emulsion downhole.

4. A process according to claim 2 including forming a portion of said first hydrocarbon-in-water emulsion at the well head.

5. A process according to claim 4 including providing a static mixer at the well head for forming homogeneous hydrocarbon-in-water emulsion.

6. A process according to claim 1 including collecting said emulsion and feeding said collected emulsion to a static mixer for forming a homogeneous hydrocarbon-in-water emulsion prior to degassing said hydrocarbon-in-water emulsion.

7. A process according to claim 1 including providing an emulsifier for forming said first hydrocarbon-in-water emulsion selected from the group consisting of non-ionic surfactants, polymers, biosurfactants, cationic surfactants, anionic surfactants, alkalies and mixtures thereof.

8. A process according to claim 7 including providing an emulsifier for forming said first hydrocarbon-in-water emulsion selected from the group consisting of ethoxylated alkyl phenols, ethoxylated alcohols, ethoxylated sorbitan esters and mixtures thereof.

9. A process according to claim 1 including providing an emulsifier for forming said second hydrocarbon-in-water emulsion wherein said emulsifier is selected from the group consisting of non-ionic surfactants and alkalies.

10. A process according to claim 1 including providing an emulsifier for forming said second hydrocarbon-in-water emulsion wherein said emulsifier is selected from the group consisting of non-ionic surfactants and an additive selected from the group consisting of $Na^+$, $K^+$, $Li^+$, $Ca^{++}$, $Ba^{++}$, $Mg^{++}$, $Fe^{+++}$ and mixtures thereof

11. A process according to claims 7 or 8 including providing a non-ionic surfactant having an EO content of greater than 70%.

12. A process according to claims 9 or 10 including providing a non-ionic surfactant having an EO content of greater than 70%.

13. A process according to claim 3 including forming said portion of said first hydrocarbon-in-water emulsion downhole by injecting a mixture of said emulsifier and water.

14. A process according to claim 13 including providing an emulsifier for forming said first hydrocarbon-in-water emulsion selected from the group consisting of non-ionic surfactants, polymers, biosurfactants, cationic surfactants, anionic surfactants, alkalies and mixtures thereof.

15. A process according to claim 13 including providing an emulsifier for forming said first hydrocarbon-in-water emulsion selected from the group consisting of ethoxylated alkyl phenols, ethoxylated alcohols, ethoxylated sorbitan esters and mixtures thereof.

16. A process according to claim 13 including providing an emulsifier for forming said second hydrocarbon-in-water emulsion wherein said emulsifier is selected from the group consisting of non-ionic surfactants and alkalies.

17. A process according to claim 13 including injecting said emulsifier and water below the submersible pump for forming the emulsion.

18. A process according to claim 17 including injecting said emulsifier and water above the submersible pump for forming the emulsion.

19. A process according to claim 17 including injecting said emulsifier and water below the submersible pump into the pump casing between the stationary valve and the travelling valve for forming the emulsion.

20. A process according to claim 1 including the step of conditioning said re-emulsified naturally occurring hydrocarbon material for further refining.

21. A process according to claim 20 including forming a portion of said first hydrocarbon-in-water emulsion downhole.

22. A process according to claim 20 including forming a portion of said first hydrocarbon-in-water emulsion at the well head.

23. A process according to claim 20 including providing a static mixer at the well head for forming homogeneous hydrocarbon-in-water emulsion.

24. A process according to claim 20 including providing an emulsifier for forming said second hydrocarbon-in-water emulsion comprising a non-ionic surfactant in combination with an alkali.

25. A process according to claim 24 wherein said emulsifier comprises an alkyl phenol ethoxylate having an EO content of greater than or equal to 70% and an alkali selected from the group consisting of ammonia, monovalent hydroxides and mixtures thereof.

26. A process according to claim 1 wherein the gas content is less than 2 cubic ft. of gas per barrel of emulsion.

27. A process for recovering a naturally occurring viscous hydrocarbon material for further processing comprising the steps of:

(a) forming a first hydrocarbon-in-water emulsion from said naturally occurring viscous hydrocarbon material using an emulsifier wherein, said hydrocarbon-in-water emulsion has a water content of at least 15 wt. %, a viscosity of no more than 5000 centipoise at 122° F. and an oil droplet size of no more than 300 microns; and (b) degassing said first hydrocarbon-in-water emulsion at a temperature of as low as 95° F. at a pressure of at least 30 psi so as to obtain a degassing efficiency of said hydrocarbon-in-water emulsion of greater than or equal to 90% so as to produce a degassed hydrocarbon-in-water emulsion having a gas content of less than 5 cubic ft. of gas per barrel of emulsion.

28. A process according to claim 27 including forming a portion of said first hydrocarbon-in-water emulsion downhole.

29. A process according to claim 27 including forming a portion of said first hydrocarbon-in-water emulsion at the well head.

30. A process according to claim 29 including providing a static mixer at the well head for forming homogeneous hydrocarbon-in-water emulsion.

31. A process according to claim 27 including collecting said emulsion and feeding said collected emulsion to a static mixer for forming a homogeneous hydrocarbon-in-water emulsion prior to degassing said hydrocarbon-in-water emulsion.

32. A process according to claim 27 including providing an emulsifier for forming said first hydrocarbon-in-water emulsion selected from the group consisting of non-ionic surfactants, polymers, biosurfactants, cationic surfactants, anionic surfactants, alkalies and mixtures thereof.

33. A process according to claim 32 including providing an emulsifier for forming said first hydrocarbon-in-water emulsion selected from the group consisting of ethoxylated alkyl phenols, ethoxylated alcohols, ethoxylated sorbitan esters and mixtures thereof.

34. A process according to claim 27 including injecting said emulsifier and water below the submersible pump for forming the emulsion.

35. A process according to claim 34 including injecting said emulsifier and water above the submersible pump for forming the emulsion.

36. A process according to claim 34 including injecting said emulsifier and water below the submersible pump into the pump casing between the stationary valve and the travelling valve for forming the emulsion.

37. A process for breaking of a hydrocarbon-in-water emulsion comprising the steps of:

(a) adjusting the density difference between the hydrocarbon-in-water phases of said hydrocarbon-in-water emulsion such that the density difference between the phases is greater than or equal to $2\times10$ g/cm at a temperature T wherein the temperature T is greater than or equal to 15° C. below the cloud point of said emulsifier used in the formation of the first hydrocarbon-in-water emulsion;

(b) breaking said density adjusted hydrocarbon-in-water emulsion in a separator at said temperature T and recovering said naturally occurring hydrocarbon material separated; and (c) re-emulsifying said separated naturally occurring hydrocarbon material using an emulsifier and conditioning same for further processing so as to form a stable secondary hydrocarbon-in-water emulsion suitable for transportation.

38. A process according to claim 37 including adjusting the density difference by adding a salt to said emulsion.

39. A process according to claim 37 including adjusting the density difference by adding a diluent to said emulsion.

40. A process according to claim 37 including adjusting the density difference by adding a mixture of salt and diluent to said emulsion.

41. A process according to claim 37 including adjusting the density difference by adding a de-emulsifier selected from the group consisting of salts of $Ca^{++}$, $Mg^{++}$, $Al^{+++}$ and cationics such as $SO_4^{=}$ and $HPO_3^{=}$ to said emulsion.

42. A process according to claim 41 wherein said de-emulsifier is an ionic surfactant.

43. A process according to claim 37 including providing an emulsifier for forming said second hydrocarbon-in-water emulsion wherein said emulsifier is a non-ionic surfactant in combination with an alkali.

44. A process according to claim 37 including providing an emulsifier for forming said second hydrocarbon-in-water emulsion wherein said emulsifier is a non-ionic surfactant in combination with an additive selected from the group consisting of $Na^{+}$, $K^{+}$, $Li^{+}$, $Ca^{++}$, $Ba^{++}$, $Mg^{++}$, $Fe^{+++}$ and mixtures thereof.

45. A process according to claim 44 wherein said additive is added to said emulsion in a molar ratio amount of additive to sulfur in the hydrocarbon of greater than or equal to 0.050.

* * * * *

UNITED STATES PATENT AND TRADEMARK OFFICE

CERTIFICATE OF CORRECTION

PATENT NO. : 4,795,478

DATED : January 3, 1989

INVENTOR(S) : Ignacio A. Layrisse R. et al.

It is certified that error appears in the above-identified patent and that said Letters Patent is hereby corrected as shown below:

In Column 25, claim 37, line 5, change "2 X 10 g/cm" to read --$2 \times 10^{-3}$ g/$cm^3$--.

Signed and Sealed this

Thirtieth Day of May, 1989

*Attest:*

*Attesting Officer*

DONALD J. QUIGG

*Commissioner of Patents and Trademarks*